US012471693B2

(12) United States Patent
Cigard et al.

(10) Patent No.: US 12,471,693 B2
(45) **Date of Patent: *Nov. 18, 2025**

(54) MODULAR GEAR BAG SYSTEM

(71) Applicant: 5.11, Inc., Manteca, CA (US)

(72) Inventors: Tyler Cigard, Irvine, CA (US); Sharon Jieun Park, Irvine, CA (US); Katelyn Fukushima, Irvine, CA (US); Scott Lambert, Irvine, CA (US)

(73) Assignee: Fisher & Paykel Healthcare Limited, Auckland (NZ)

( * ) Notice: Subject to any disclaimer, the term of this patent is extended or adjusted under 35 U.S.C. 154(b) by 252 days.

This patent is subject to a terminal disclaimer.

(21) Appl. No.: 17/812,976

(22) Filed: Jul. 15, 2022

(65) Prior Publication Data

US 2022/0346534 A1 Nov. 3, 2022

Related U.S. Application Data

(63) Continuation of application No. 16/748,502, filed on Jan. 21, 2020, now Pat. No. 11,388,978.

(60) Provisional application No. 62/795,168, filed on Jan. 22, 2019.

(51) Int. Cl.
*A45F 4/02* (2006.01)
*A45F 3/00* (2006.01)

(52) U.S. Cl.
CPC ..... *A45F 4/02* (2013.01); *A45F 2003/003* (2013.01); *A45F 2004/023* (2013.01)

(58) Field of Classification Search
CPC ..... A45F 2003/001; A45F 2003/003; A45F 3/04; A45F 3/06; A45F 2200/0591
USPC ..... 224/581–583, 650, 684, 249, 655
See application file for complete search history.

(56) References Cited

U.S. PATENT DOCUMENTS

| | | | |
|---|---|---|---|
| 5,246,153 | A | 9/1993 | Beletsky |
| 5,311,972 | A | 5/1994 | Plath |
| 5,431,317 | A | 7/1995 | Kliot |
| 5,775,558 | A | 7/1998 | Montalbano |
| 5,785,427 | A | 7/1998 | Godshaw |
| 5,806,740 | A | 9/1998 | Carlson |
| 6,619,447 | B1 | 9/2003 | Garcia, III et al. |
| 6,874,618 | B1 | 4/2005 | Cragg |
| 7,080,430 | B2 | 7/2006 | Wemmer |
| 7,255,252 | B2 | 8/2007 | Lovett |
| 7,287,813 | B2 | 10/2007 | Aliev |
| 7,451,872 | B1 | 11/2008 | Allen |
| 7,661,566 | B2 | 2/2010 | Yoshie et al. |
| 7,681,255 | B2 | 3/2010 | Morales et al. |
| 8,079,503 | B1 | 12/2011 | Yeates et al. |
| 8,714,422 | B2 | 5/2014 | Yu |
| 8,857,681 | B2 | 10/2014 | Burnett et al. |

(Continued)

FOREIGN PATENT DOCUMENTS

| | | |
|---|---|---|
| DE | 102010024544 | 12/2011 |
| JP | 4750094 | 8/2011 |
| JP | 5774644 | 9/2015 |

*Primary Examiner* — Scott T McNurlen
(74) *Attorney, Agent, or Firm* — VIA LLP

(57) ABSTRACT

Modular bag system having one or more base bags and a plurality of attachable gear sets. In some configurations, a base bag or a gear set includes a pocket flap that easily moves from an external orientation to an internal orientation to permit access to the pocket. In some configurations, a bag has a strap arrangement that converts from a two-strap arrangement to a single-strap arrangement.

9 Claims, 18 Drawing Sheets

(56) References Cited

U.S. PATENT DOCUMENTS

| | | | | |
|---|---|---|---|---|
| 8,919,628 | B2 * | 12/2014 | Jamlang | A45F 3/10 224/583 |
| 9,010,595 | B2 | 4/2015 | Yu | |
| 10,010,159 | B1 * | 7/2018 | Gonzales | A45F 3/047 |
| 10,165,841 | B2 * | 1/2019 | Dalton | A45C 13/30 |
| 10,463,135 | B2 | 11/2019 | Hunt et al. | |
| 2004/0206795 | A1 * | 10/2004 | Kang | A45F 4/02 224/576 |
| 2010/0301085 | A1 * | 12/2010 | Smith | A45F 3/14 224/645 |
| 2011/0204114 | A1 | 8/2011 | Miller | |
| 2012/0241482 | A1 * | 9/2012 | Mabika | A45C 3/06 224/191 |
| 2013/0032502 | A1 * | 2/2013 | Anderson | A45C 13/08 206/457 |
| 2014/0224854 | A1 * | 8/2014 | Asokaraj | A45C 15/00 224/576 |
| 2017/0182652 | A1 | 6/2017 | Martinez et al. | |
| 2017/0332756 | A1 | 11/2017 | Ford | |
| 2018/0271262 | A1 * | 9/2018 | Hoge | A01M 31/006 |
| 2019/0008265 | A1 * | 1/2019 | Mitchell | A45F 3/02 |

* cited by examiner

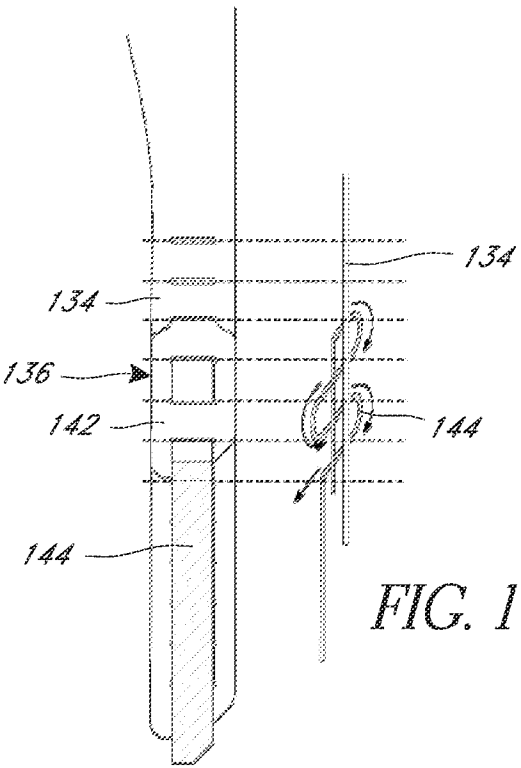
FIG. 11
FIG. 10
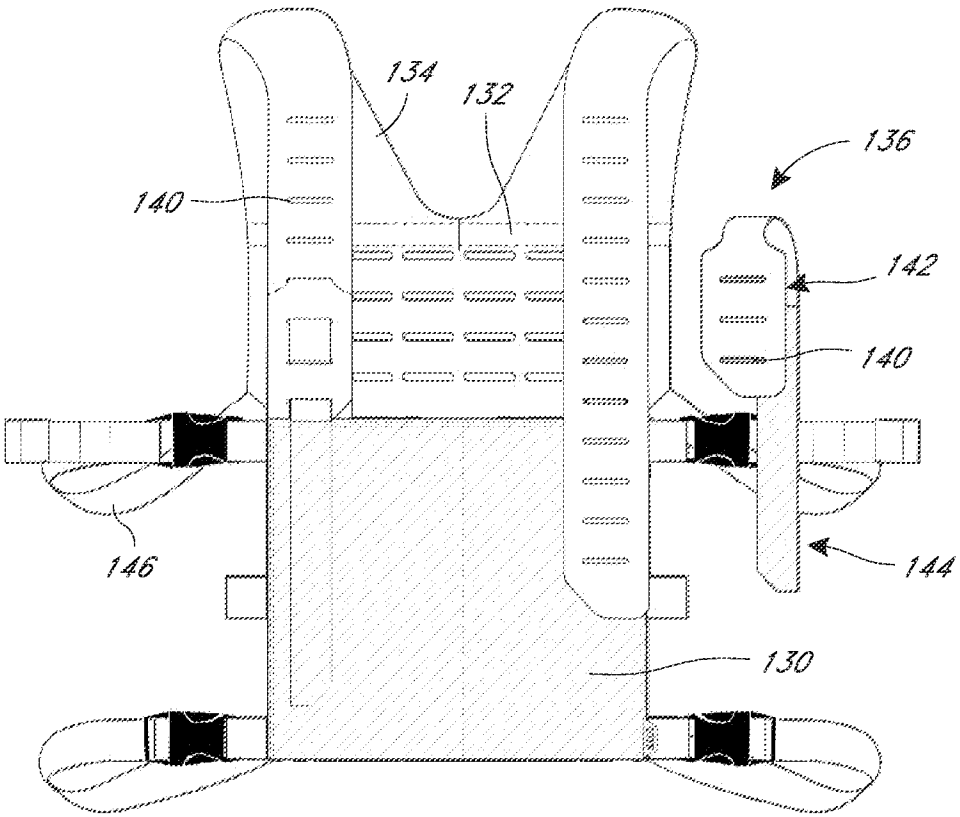
FIG. 9

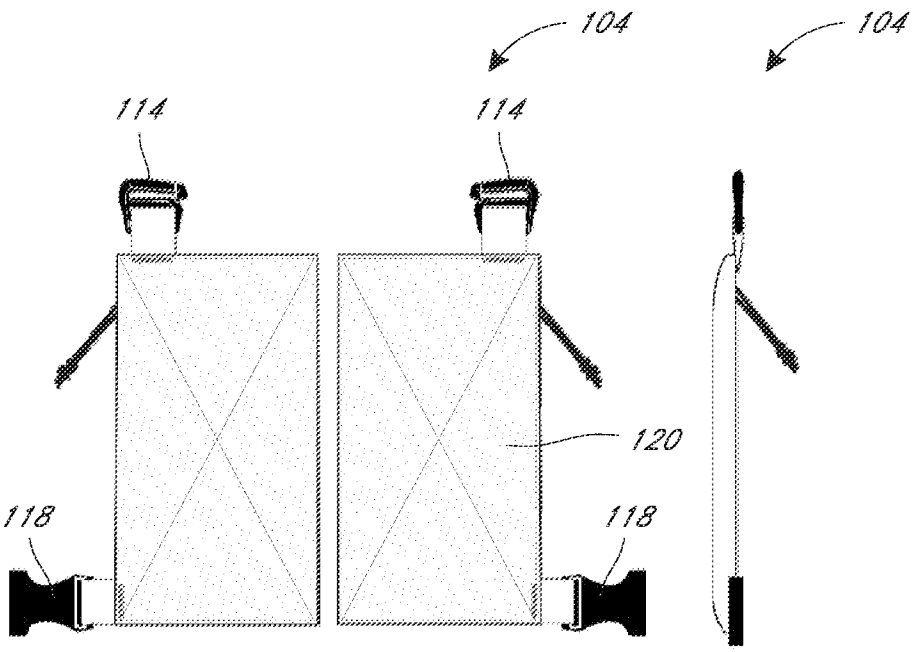
FIG. 28
FIG. 27
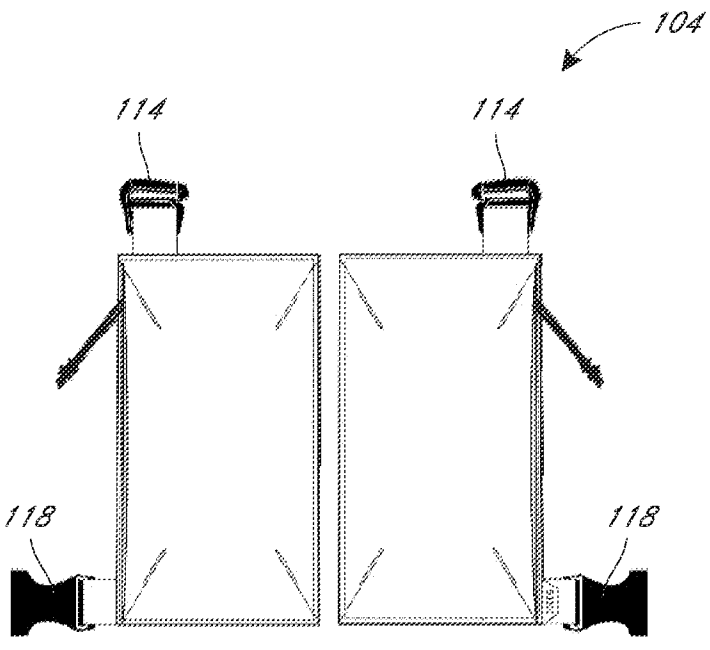
FIG. 26

MODULAR GEAR BAG SYSTEM

BACKGROUND

Field

The present disclosure generally relates to gear bags and in particular to a modular bag system.

Description of Related Art

Many examples of gear bags exist in the prior art. However, a need remains for bags having improved features and bag systems that provide new or desirable combinations of bags and accessories, or at least provide the public with a useful choice.

SUMMARY

The systems, methods and devices described herein have innovative aspects, no single one of which is indispensable or solely responsible for their desirable attributes. Without limiting the scope of the claims, some of the advantageous features will now be summarized.

An embodiment involves a modular gear bag system including at least one gear bag, a plurality of accessories, and an accessory mount configured to selectively couple any selected one of the plurality of accessories to the at least one gear bag. The accessory mount comprises a first connection arrangement of a first type and a second connection arrangement of a second type.

In some configurations, the accessory mount further comprises a third connection arrangement of a third type.

In some configurations, the first connection arrangement is a hook-and-loop fastener, the second connection arrangement is a clip and loop coupling, and the third connection arrangement is a snap-fit buckle.

In some configurations, the plurality of accessories includes one or more of a webbing platform, a helmet carrier, an admin set, a double deploy set, and a webbing platform having a kangaroo pocket.

An embodiment involves an arrangement for converting a backpack or other type of bag from a double strap configuration to a single strap configuration, in which one strap is removable from the backpack or bag, and the remaining strap has one end connected to an opposite side of the backpack or bag.

In some configurations, an unused lower strap of the backpack or bag is connected to the remaining strap in a cross-body orientation.

BRIEF DESCRIPTION OF THE DRAWINGS

The foregoing and other features of the present disclosure will become more fully apparent from the following description and appended claims, taken in conjunction with the accompanying drawings. Understanding that these drawings depict only several embodiments in accordance with the disclosure and are not to be considered limiting of its scope, the disclosure will be described with additional specificity and detail through the use of the accompanying drawings.

FIG. 9 is a front view of the vest of FIG. 7 with one connector strap shown separated from a remainder of the vest.

FIG. 10 is an enlarged front view of the connection of the shoulder strap to a front panel of the tactical vest of FIG. 7 using the connector strap.

FIG. 11 is a side view of the connection of the shoulder strap to a front panel of the tactical vest of FIG. 7 using the connector strap.

FIG. 26 is a front view of an accessory in the form of a double deploy gear set.

FIG. 27 is a rear view of the accessory of FIG. 26.

FIG. 28 is a side view of the accessory of FIG. 26.

DETAILED DESCRIPTION

Figure 2:
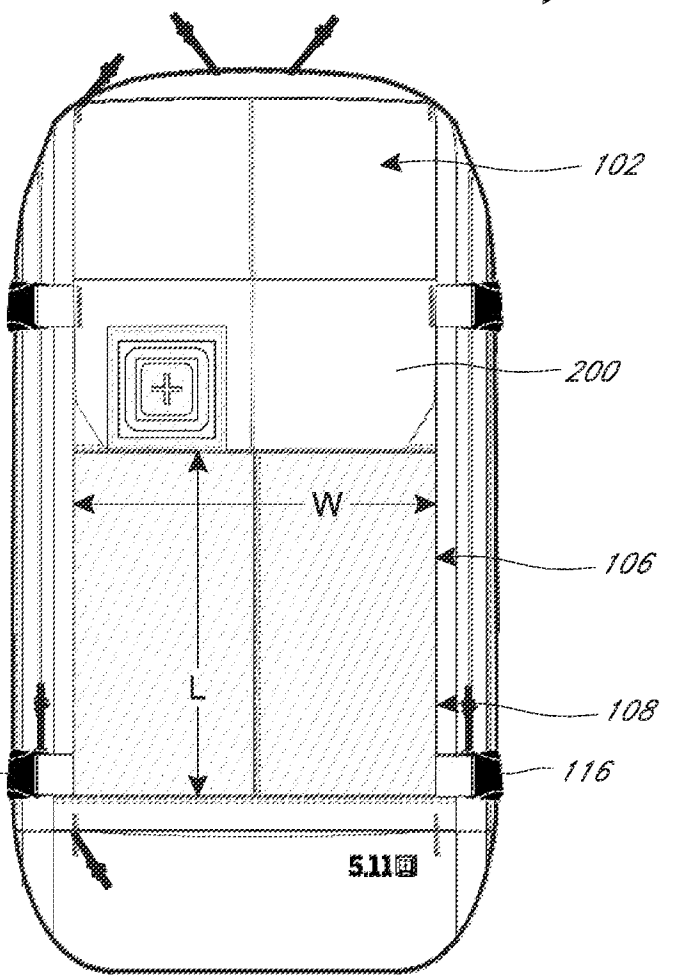
FIG. 2 is a front view of the backpack of FIG. 1 with the accessory removed.
Figure 1:
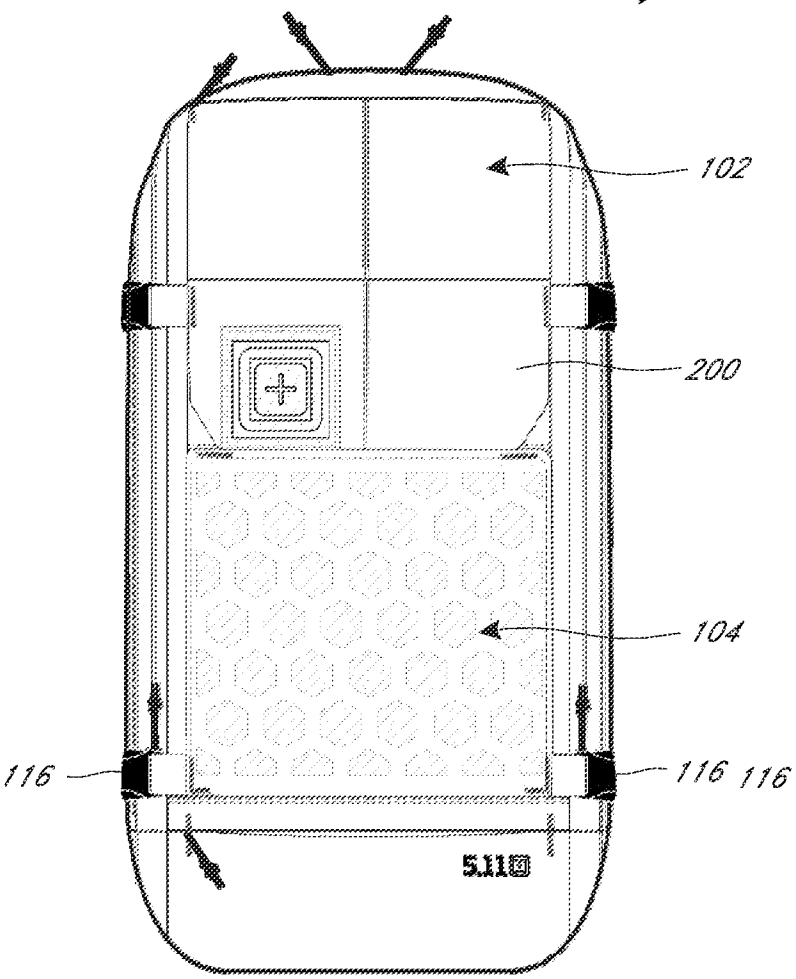
FIG. 1 is a front view of a modular gear bag system having a load bearing platform in the form of a backpack and an accessory in the form of a webbing platform attached to the backpack.

Embodiments of systems, components and methods of assembly and manufacture will now be described with reference to the accompanying Figures, wherein like numerals refer to like or similar elements throughout. Although several embodiments, examples and illustrations are disclosed below, it will be understood by those of ordinary skill in the art that the inventions described herein extends beyond the specifically disclosed embodiments, examples and illustrations, and can include other uses of the inventions and obvious modifications and equivalents thereof. The terminology used in the description presented herein is not intended to be interpreted in any limited or restrictive manner simply because it is being used in conjunction with a detailed description of certain specific embodiments of the inventions. In addition, embodiments of the inventions can comprise several novel features and no single feature is solely responsible for its desirable attributes or is essential to practicing the inventions herein described.

Certain terminology may be used in the following description for the purpose of reference only, and thus are not intended to be limiting. For example, terms such as "above" and "below" refer to directions in the drawings to which reference is made. Terms such as "front," "back," "left," "right," "rear," and "side" describe the orientation and/or location of portions of the components or elements within a consistent but arbitrary frame of reference which is made clear by reference to the text and the associated drawings describing the components or elements under discussion. Moreover, terms such as "first," "second," "third," and so on may be used to describe separate components. Such terminology may include the words specifically mentioned above, derivatives thereof, and words of similar import.

The figures illustrate certain embodiments and components of a modular gear bag system 100. In some configurations, the system 100 includes one or more underlying base elements or load bearing platforms 102, such as a bag (e.g., backpack, duffel bag) or a tactical vest, for example and without limitation. The platform 102 is adapted for connection with one or more of a selection of auxiliary items or accessories 104, such as auxiliary pockets, bags, or webbing or other platforms (e.g., ladder webbing, such as Pouch Attachment Ladder System (PALS) or HEXGRID® mounting system). For convenience, references to any particular item as the load bearing platform 102 is intended to cover other possible categories of load bearing platforms 102 unless a contrary intent is made explicit or is clearly intended by the context of the disclosure. Thus, references to a bag as the load bearing platform 102 shall also cover a tactical vest, and vice-versa. Similarly, references to a backpack as the load bearing platform 102 shall also cover a duffel bag, and vice-versa. Also, references to any particular accessory 104 shall cover other accessories 104 unless otherwise noted or made clear by the context of the disclosure.

Modular System

Figure 4:
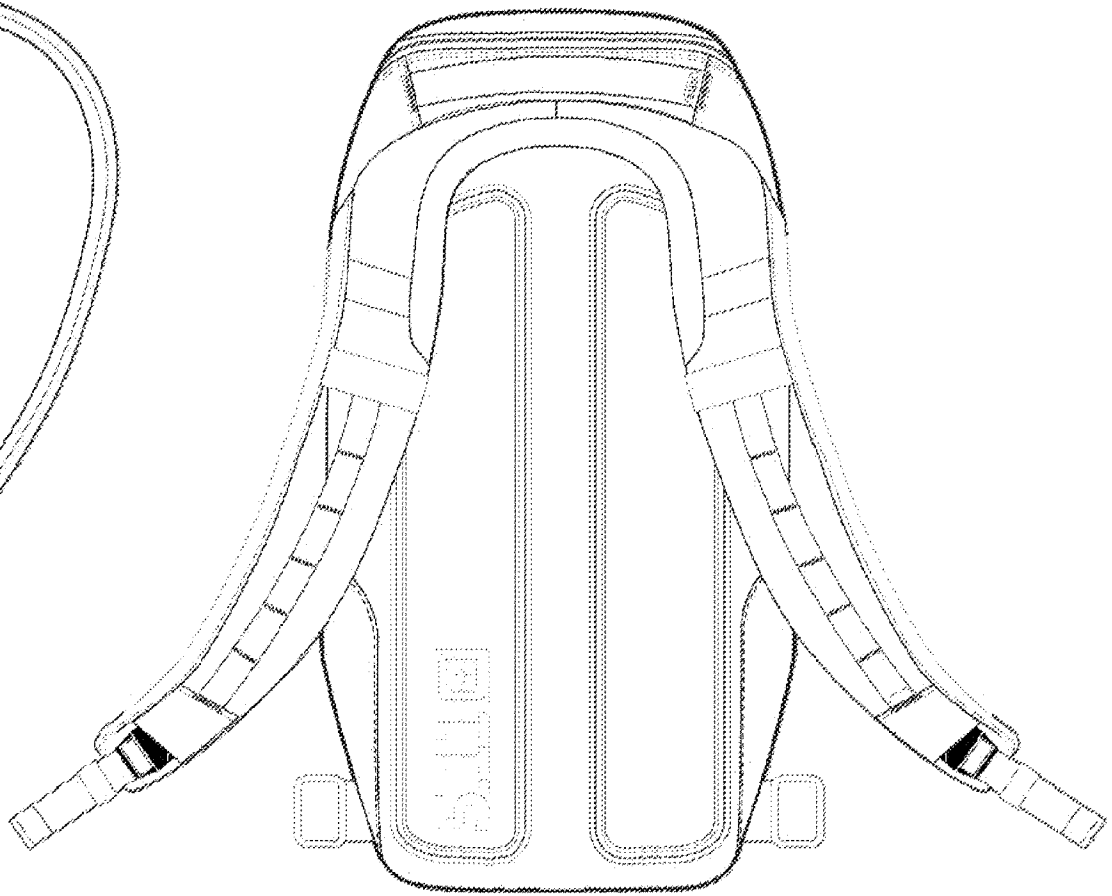
FIG. 4 is a rear view of the backpack of FIG. 1.
Figure 3:
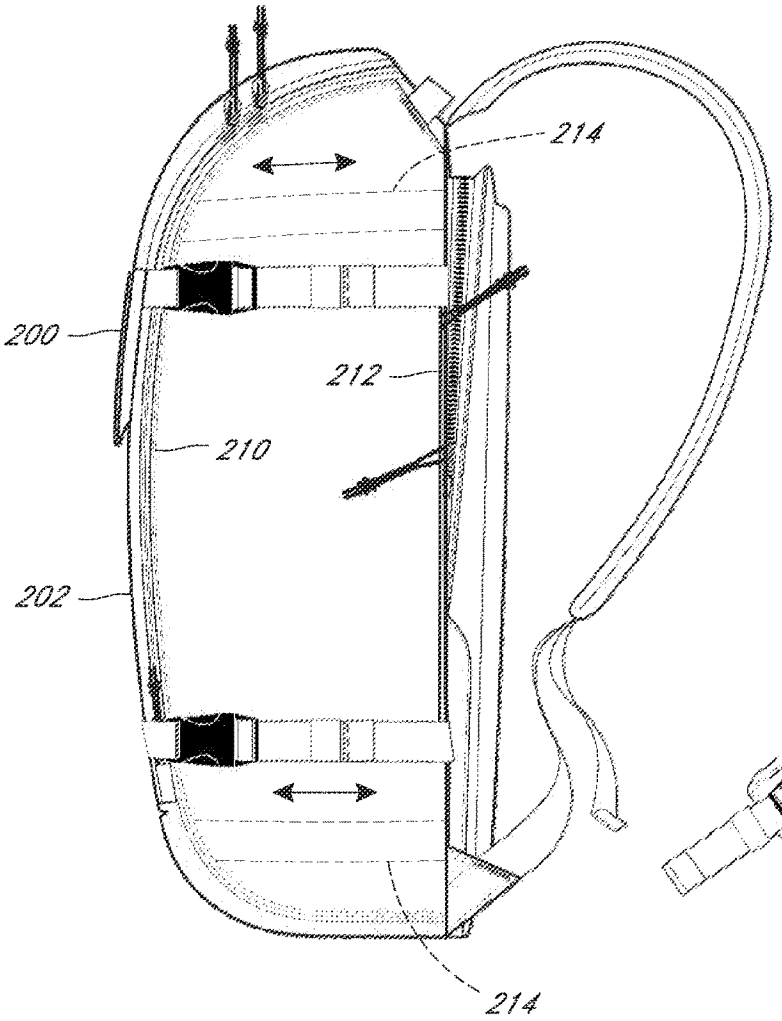
FIG. 3 is a side view of the backpack of FIG. 1.
Figure 6:
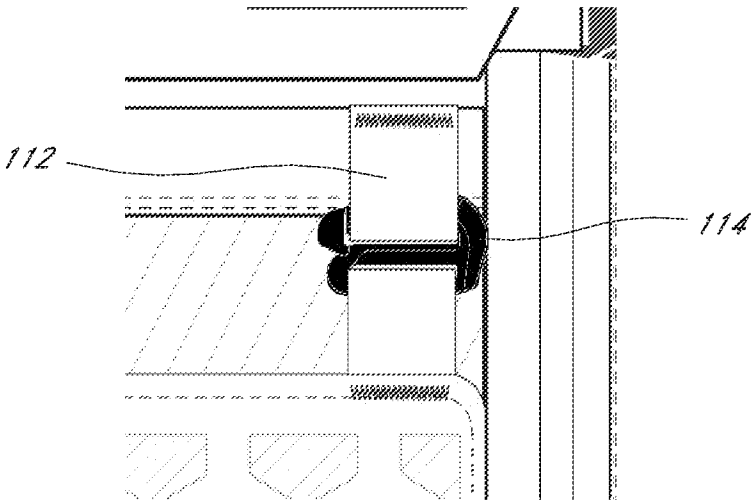
FIG. 6 is a close-up view of the connection of FIG. 5.
Figure 5:
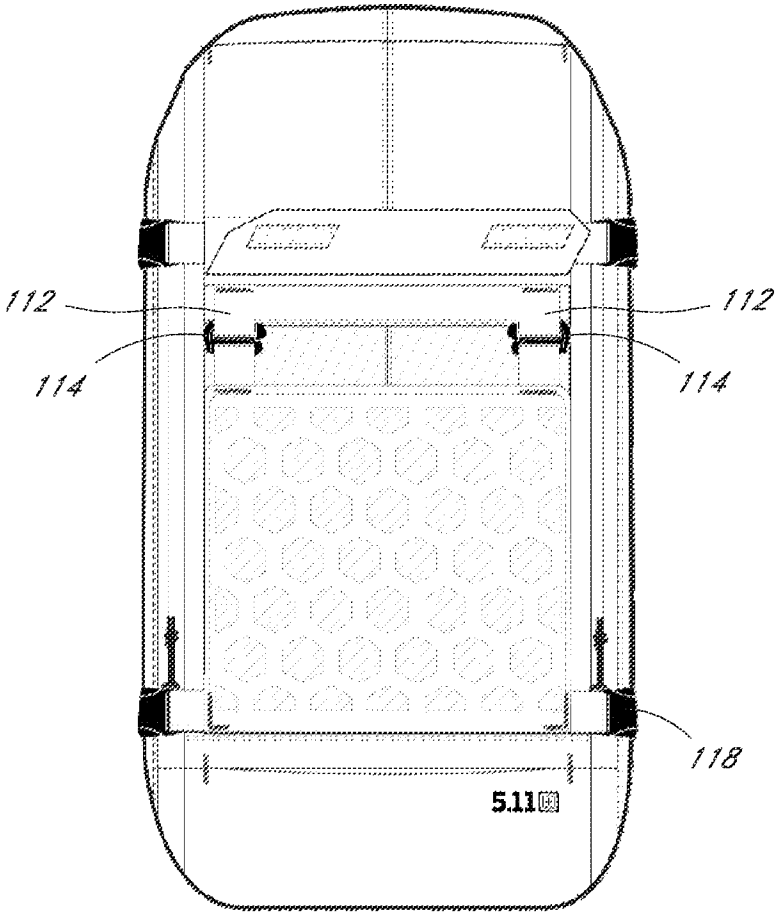
FIG. 5 is a front view of the backpack of FIG. 1 with a flap of the backpack lifted to illustrate a connection between the accessory and the backpack.
Figure 8:
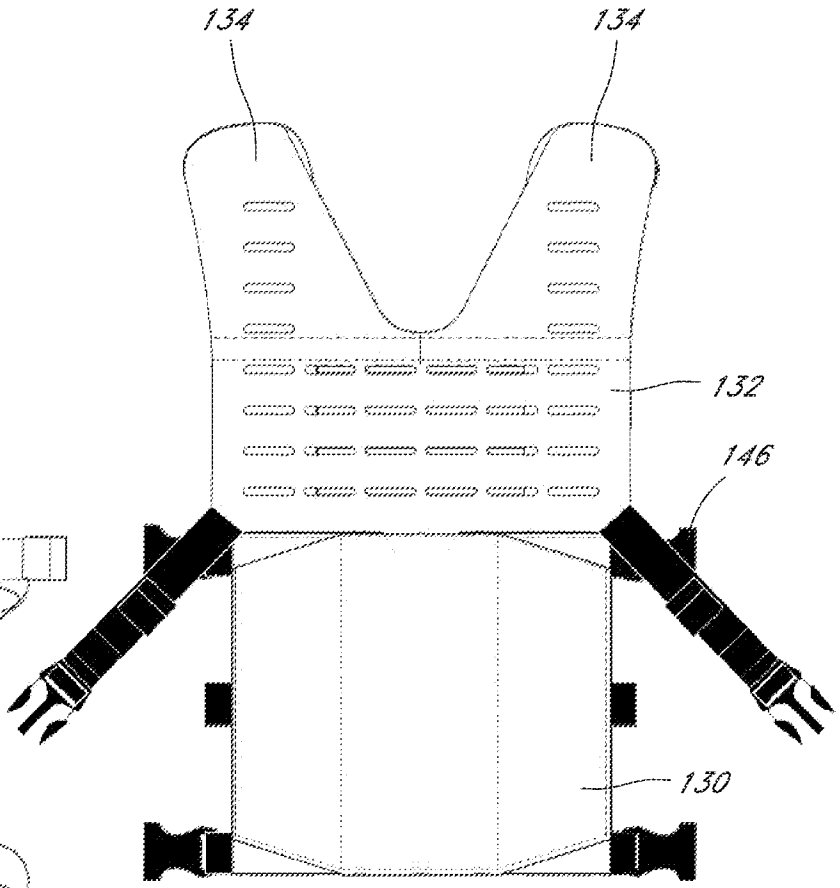
FIG. 8 is a rear view of the vest of FIG. 7.

FIGS. 1-6 illustrate a backpack 102 having some or all the typical features of a known backpack, such as a body portion defining an interior space and one or more (usually a pair) external carrying straps (FIGS. 3 and 4). The illustrated backpack 102 also includes a panel or surface 106 having a mounting location or accessory mount 108. The accessory mount 108 is illustrated on an external surface of the backpack 102 (e.g., front, back, top, bottom or side surface); however, in other arrangements the accessory mount 108 can be located on an internal surface, such as a (e.g., front, back, top, bottom or side surface) surface defining an interior space (e.g., a cargo space) of the backpack 102.

Figure 16:
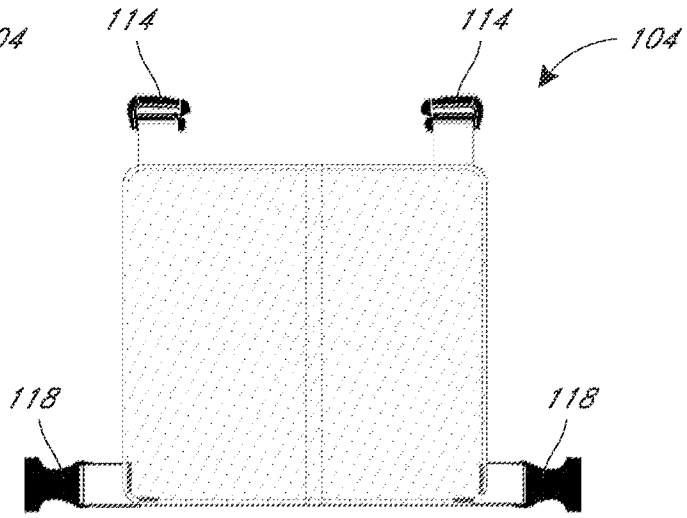
FIG. 16 is a rear view of the accessory of FIG. 15.

The accessory mount 108 is configured to securely receive one or more accessories, such as a loading platform (e.g., webbing platform), bag or pocket. The illustrated accessory mount 108 includes a coupling area 110 (FIG. 2) in the form of one part of a connector or connection system, such as a hook-and-loop fastener. In the illustrated arrangement, the coupling area 110 is a loop portion of a hook-and-loop fastener. The illustrated coupling area 110 covers a substantial portion of the panel (e.g., front panel) of the backpack 102 on which it resides. The illustrated coupling area 110 is a square area denoted by a hatched pattern of diagonal lines. In some configurations, the coupling area 110 is sized to overlap with an entirety or a substantial entirety of a surface (e.g., a rear surface) of one or more (e.g., multiple or all) of the associated accessories 104. That is, a length L and width W of the coupling area 110 can be the same or greater than a respective length and width of the associated accessory 104 in an in-use orientation. The accessory 104 includes a coupling area 120 (e.g., FIGS. 16 and 20) in the form of a second part of the hook-and-loop fastener. The coupling area 120 can cover a substantial portion of the panel or surface (e.g., rear surface) of the accessory 104 on which it resides. Thus, the coupling areas 110, 120 provide a first connection type between the backpack 102 and the accessory 104 that provides substantial retention of the accessory 104 on the backpack 102. As used herein, substantial retention means that the accessory 104 is retained on the backpack 102 such that it can support at least its own weight and, preferable, an additional force, such as that produced by an object supported by the accessory 104.

The accessory mount 108 of the backpack 102 can also include one or more (e.g., a pair of) connectors of a second connection type. For example, the backpack 102 can include a pair of clip receivers, such as loops 112 (FIGS. 5 and 6) configured to receive a clip or hook, such as a G-hook 114, of the accessory 104. In other configurations, this arrangement could be reversed such that the loops 112 are located on the accessory 104 and the G-hooks 114 are located on the backpack 102. In the illustrated arrangement, the loops 112 are located at or near upper corners of the accessory mount 108 and/or the coupling area 110. For example, the loops 112 are located above the accessory mount 108 and/or the coupling area 110 and between the opposing side edges of the accessory mount 108 and/or the coupling area 110. The loops 112 are oriented with a passage of the loop 112 being oriented aligned with or parallel to a width direction W of the accessory mount 108 and/or the coupling area 110.

The accessory mount 108 of the backpack 102 can also include one or more connectors of a third connection type. For example, the backpack 102 can include first parts 116 of a pair of snap-fit buckles (e.g., side-release (SR) buckles) configured to be releasably coupled to second parts 118 of the pair of snap-fit buckles on the accessory 104. In the illustrated arrangement, the backpack 102 includes the snap-fit or male portion 116 of the SR buckle and the accessory 104 includes the receptacle portion 118 of the SR buckle. However, this arrangement could be reversed. In the illustrated arrangement, the snap-fit portions 116 of the SR buckle are located at or near lower corners of the accessory mount 108 and/or the coupling area 110. For example, the snap-fit portions 116 of the SR buckles are located on opposing sides of the accessory mount 108 and/or the coupling area 110 and above a lower edge of the accessory mount 108 and/or coupling area 110. The receptacle portion 118 of the SR buckles are located in a corresponding location of the accessory 104. In some configurations, the snap-fit portions 116 of the SR buckles on the backpack 102 can be configured for optional use with receptacle portions of SR buckles on the backpack 102. For example, the snap-fit portions 116 of the backpack 102 can be used with cooperating receptacle portions of the backpack 102 when no accessory 104 is mounted to the accessory mount 108 and can be used with the receptacle portions 118 of the accessory 104 when an accessory 104 is mounted to the accessory mount 108.

Such an arrangement provides for convenient and secure optional mounting of an accessory 104 to the underlying backpack 102, which can be useful with multiple types of accessories 104. The accessory mount 108 can utilize any one or any combination of the connector types disclosed herein, among others. However, preferably, the accessory mount 108 utilizes at least two different types of connectors between the backpack 102 and the accessory 104, which can include any combination of the connector types disclosed herein or any suitable alternatives, to provide for a secure connection no matter which type of accessory 104 is selected. The illustrated locations are desirable in that the upper connectors 112/114 can be partially or entirely hidden by a pocket flap of the backpack 102 and the lower connectors 116/118 are provided at locations in which an SR buckle is already located on the backpack 102. However, the locations can be varied if desired.

Figure 13:
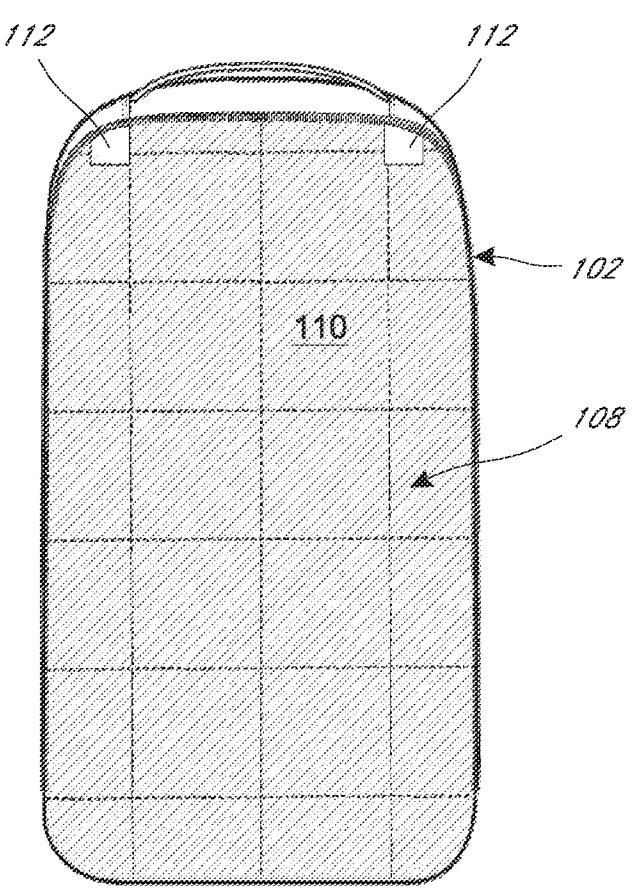
FIG. 13 illustrates an accessory mount located in an interior of a backpack.

The figures illustrate several different types (e.g., different sizes) of backpacks 102, each of which include an accessory mount 108 substantially as described above. In some embodiments, as illustrated in FIG. 13, the backpack 102 can include an accessory mount 108 on an interior surface (e.g., an interior rear surface) that includes a combination of a coupling area 110 and loops 112 arranged substantially as described above.

As mentioned above, another type of load bearing platform 102 that can be included in the system 100 is a tactical vest as illustrated in FIGS. 7-11. The figures illustrate one example of a tactical vest 102, which includes a first panel (e.g., a front panel) 130 and a second panel (e.g., a rear panel) 132. A pair of shoulder straps 134 can extend between the front panel 130 and the rear panel 132. In the illustrated arrangement, the shoulder straps 134 are formed as a single piece with the rear panel 132 and each shoulder strap 134 is connected to the front panel 130 by a connector strap element 136. Portions of the vest 102 (e.g., the rear panel 132 and the shoulder straps 134) include a plurality of slots 140 provided at regular intervals such that those portions of the vest 102 can function as ladder webbing for connection of accessories and the connector strap elements 136. The front panel 130 can include the accessory mount 108, which defines the coupling area 110. In some configurations, one or more of the first panel 130, second panel 132, shoulder straps 134 and connector strap elements 136 can be constructed of a thin, tough material, such as chlorosulfonated polyethylene (CSPE) synthetic rubber (CSM) (sold by DuPont Performance Elastomers under the tradename HYPALON) or the like.

Each connector strap element 136 includes a body portion 142 and a strap portion 144. The body portion 142 defines a plurality of slots 140 and is wider than the strap portion 144, which is sized such that the strap portion 144 can be passed through the slots 140 of the body portion 142 and of the other portions of the vest 102. The strap portion 144 also includes a part of a connector that is the same as the connector on the accessory mount 108 or coupling area 110 and a part of a connector that is opposite the connector on the accessory mount 108 or coupling area 110. Thus, one side of the strap portion 144 can connect to the coupling area 110 and the other side of the strap portion 144 can then form a replacement portion of the coupling area 110.

The connector strap elements 136 can be used to connect the shoulder straps 134 to the front panel 130 in a size adjustable manner. For example, the connector strap elements 136 can be coupled to the shoulder straps 134 at a desired location to create a desired effective length of the shoulder straps 134. The body portion 142 of the connector strap element 136 can be placed on one of the shoulder straps 134 with the slots 140 of each in alignment. The connector strap element 136 is oriented with the strap portion 144 initially extending upwards or away from the front panel 130 and the side of the strap portion 144 that couples to the coupling area 110 facing outward or on the opposite side of the shoulder strap 134. The strap portion 144 is passed through the slot 140 located nearest the base or the end of the strap portion 144 connected to the body portion 142 and then weaved through some or all of the remaining slots 140 of body portion 142 and the aligned slots 140 of the shoulder strap 134. The strap portion 144 is then coupled to the coupling area 110 of the front panel 130.

Figure 7:
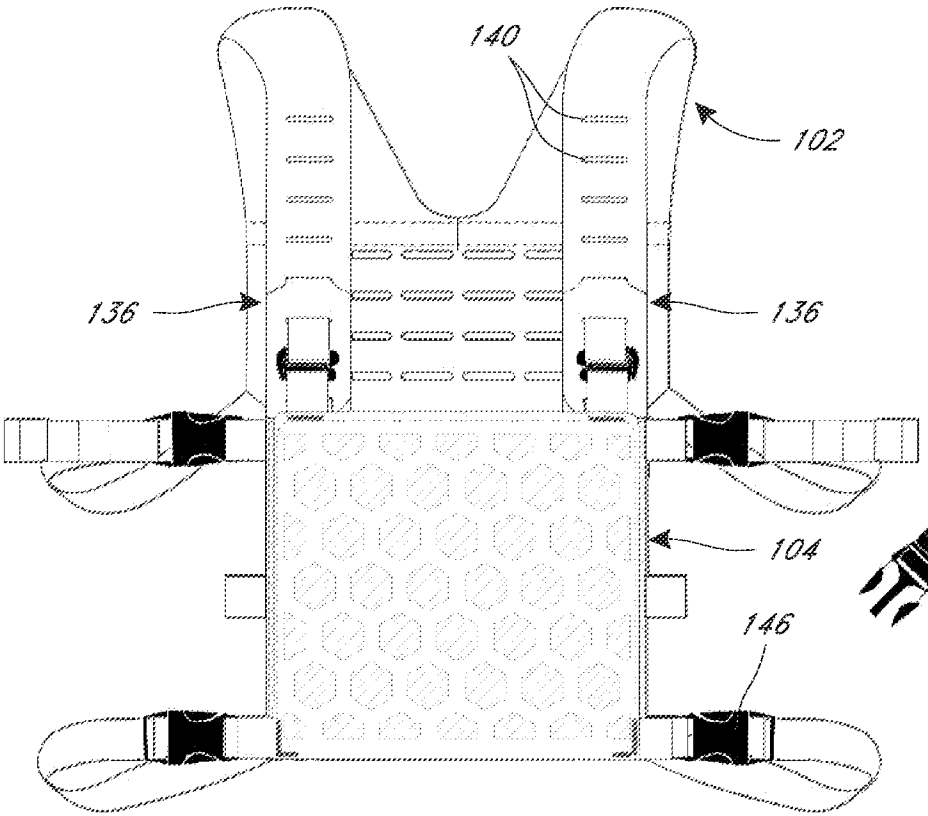
FIG. 7 is a front view of a modular system in which the load bearing platform is a tactical vest.
Figure 12:
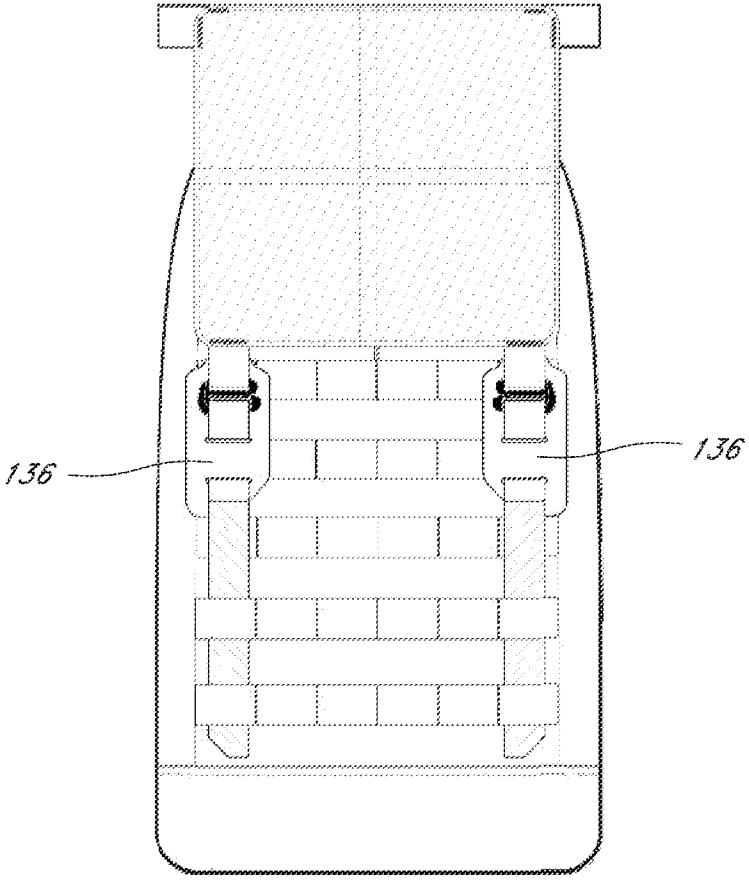
FIG. 12 is a view of the connector strap of FIGS. 7-11 used with a different load bearing platform.

The coupling area 110 of the front panel 130 can then receive accessories 104 substantially in a manner as discussed above. An exposed section of the strap portion 144 located between two slots 140 can be utilized as the loops 112 for connection of the G-hooks 114 (FIG. 7). Side straps 146 of the vest 102 and/or auxiliary straps (lower strap in FIG. 9) can couple to the receptacles 118 in a manner similar to that described above in connection with the backpacks 102. As illustrated in FIG. 12, the connector strap elements 136 can be used separately from the tactical vest 102 to connect other accessories 104 or items with any other object having webbing or similar structures through which the strap portion 144 can be passed.

Figure 14:
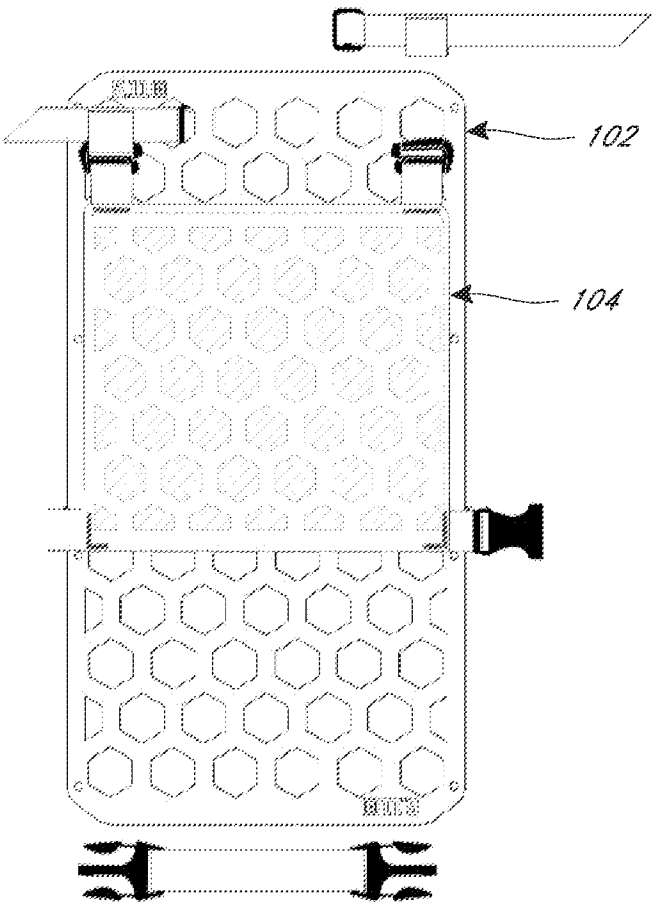
FIG. 14 is a system in which the load bearing platform is a webbing board.

FIG. 14 illustrates yet another type of load bearing platform 102 in the form of a ladder webbing plate. In particular, the ladder webbing plate includes struts that define an array of openings, which is marketed as a HEXGRID® webbing system by 5.11, Inc. The accessory 104 can be secured to the load bearing platform 102 by any suitable arrangement, such as by a plurality of straps. Thus, the load bearing platform 102 doesn't include any of the three types of connections described above.

Figure 15:
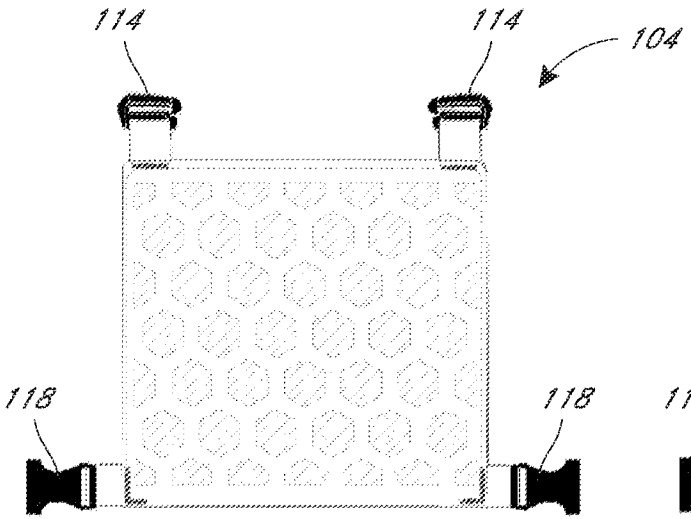
FIG. 15 is a front view of an accessory in the form of a webbing platform.
Figure 18:
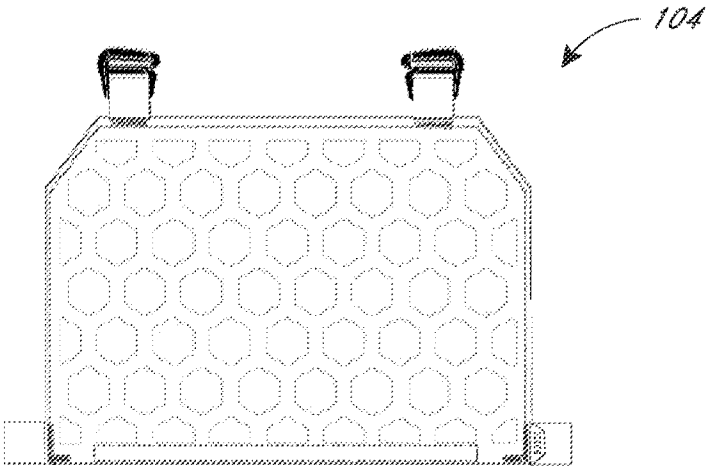
FIG. 18 is a front view of a modification of the accessory of FIG. 15 having a different size than the accessory of FIG. 15.
Figure 17:
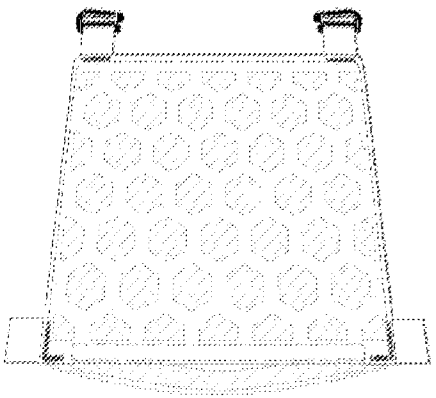
FIG. 17 is a perspective view of the accessory of FIG. 15.

FIGS. 15-30 also illustrate several different types of accessories 104, each of which can be connected to the accessory mount 108 of one or more (e.g., all) of the illustrated backpacks 102 or any other load bearing platform. One such accessory 104 is a webbing platform (FIGS. 15-18), which includes a HEXGRID® webbing system sold by 5.11, Inc. However, other types of webbing platforms can also be used, such as any suitable type of ladder webbing (e.g., Pouch Attachment Ladder System (PALS)). The webbing platforms can be provided in multiple sizes, such as 9"×9" (FIGS. 15-17) and 12"×9" (FIG. 18). In some configurations, at least one end or edge of the platform 104 is has a separation between a base layer and the webbing layer to ease threading of objects through the webbing layer. In the illustrated arrangement, the lower end or edge defines such a separation; however, any or all other edges could similarly define a separation between layers. In some configurations, the base layer is one part (e.g., a loop portion) of a fastener (e.g., a hook-and-loop fastener).

Figures 19, 20, 21:
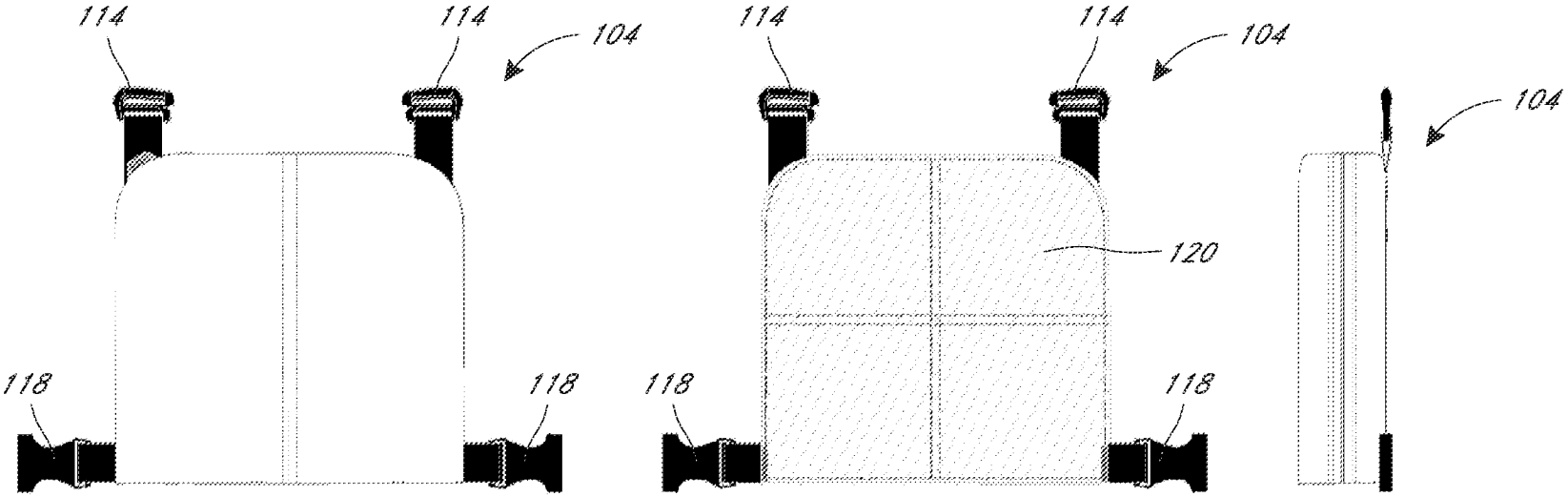
FIG. 19 is a front view of an accessory in the form of an admin gear set.
FIG. 20 is a rear view of the accessory of FIG. 19.
FIG. 21 is a side view of the accessory of FIG. 19.
Figure 23:
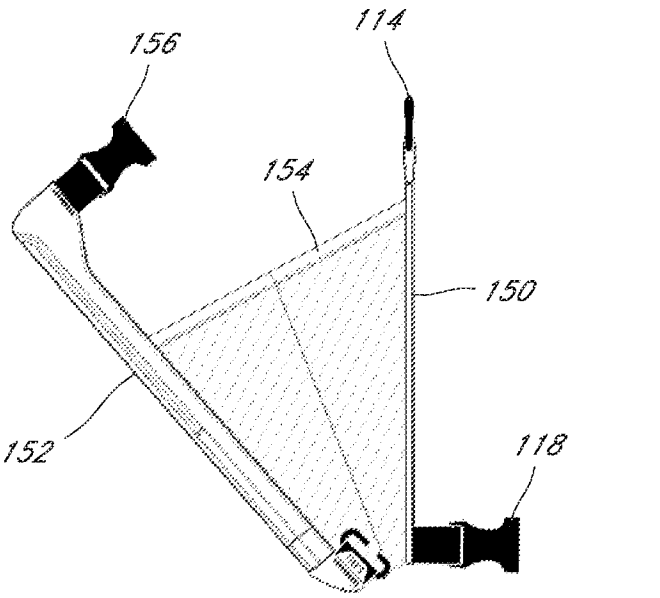
FIG. 23 is a side view of the helmet carrier accessory of FIG. 22.
Figure 22:
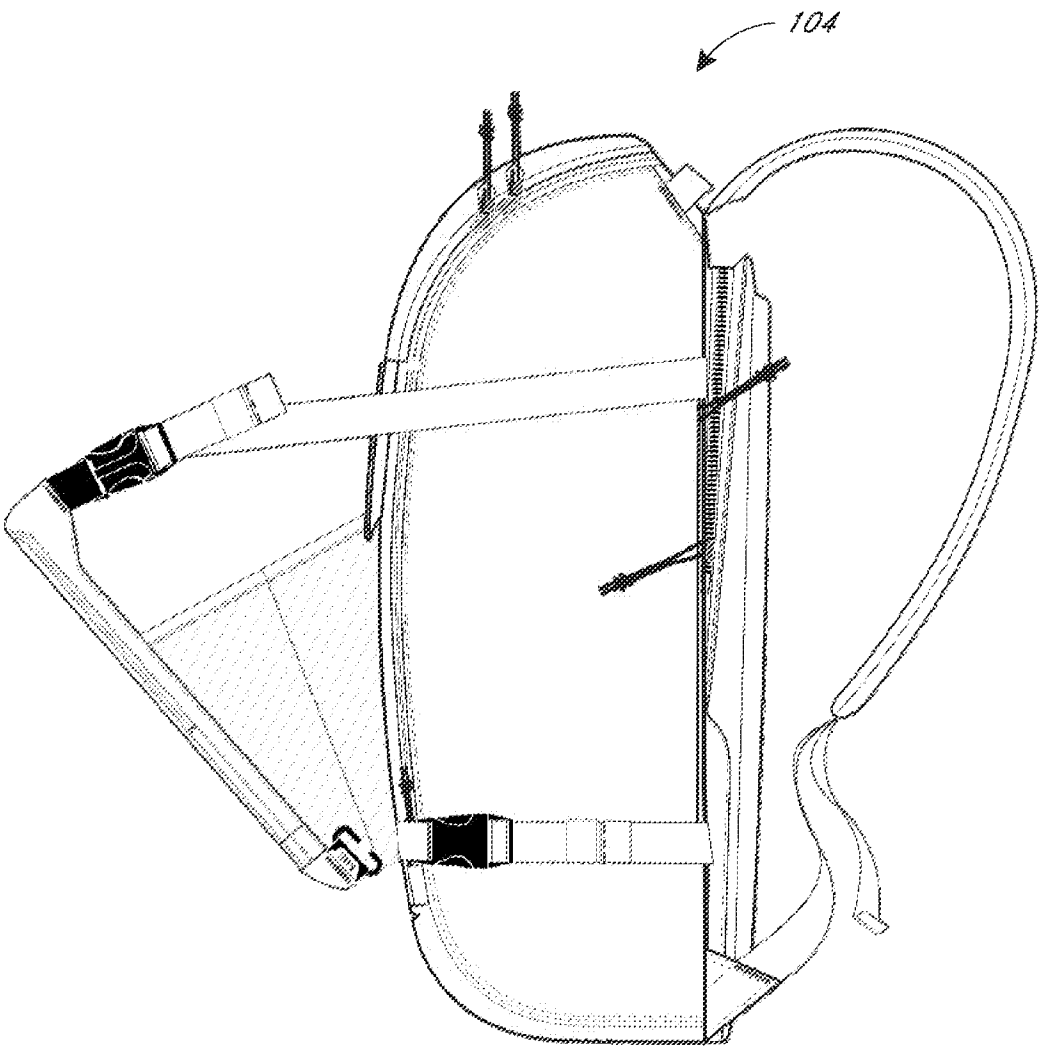
FIG. 22 is a side view of a backpack supporting an accessory in the form of a helmet carrier.
Figure 25:
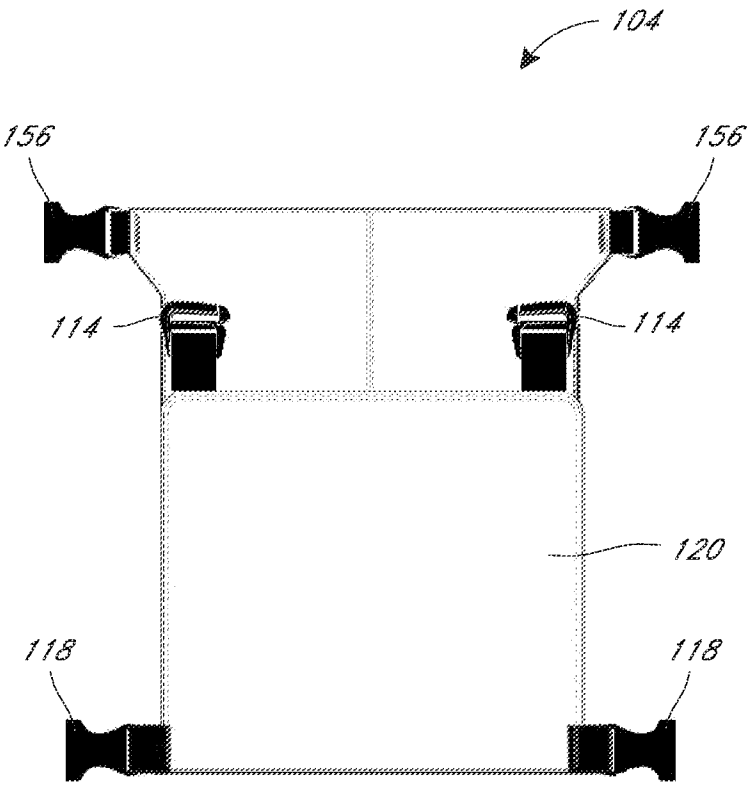
FIG. 25 is a rear view of the helmet carrier accessory of FIG. 22.
Figure 24:
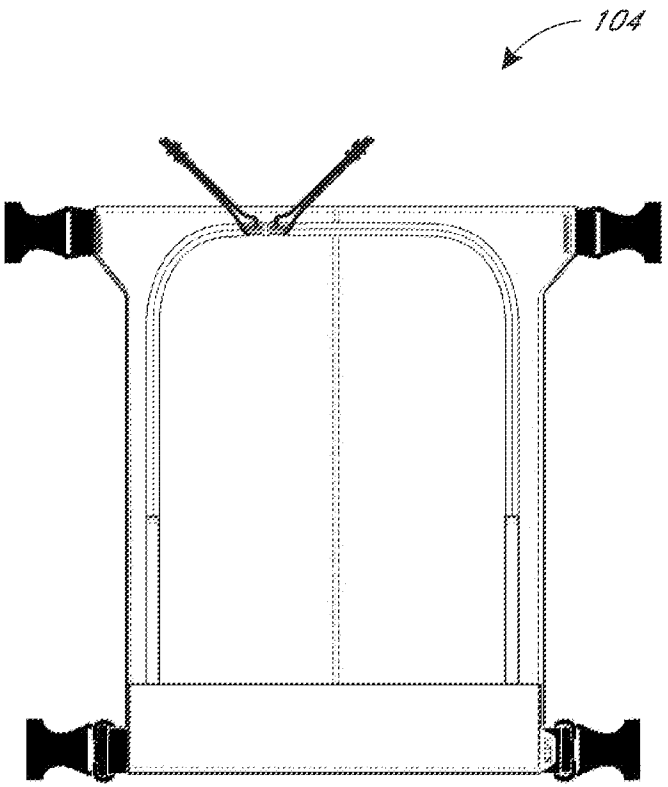
FIG. 24 is a front view of the helmet carrier accessory of FIG. 22.

With reference to FIGS. 19-21, another accessory 104 is an "admin" gear set having a body that defines an interior space, which can be accessed via a zipper or other suitable arrangement. With reference to FIGS. 26-28, yet another accessory 104 is a "double deploy" gear set comprised of two separate pouches. Each of the pouches has a side-entry zipper compartment located on opposite sides from one another when the pouches are attached to the backpack 102.

With reference to FIGS. 22-25, another accessory 104 is a helmet carrier 104, which includes a first panel 150 that couples to the coupling area 110 of the backpack 102 (or other load bearing platform) as described above and a second panel 152 that is movable relative to the first panel 150. In particular, the second panel 152 can be coupled to the first panel 150 by side portions 154 that permit the second panel 152 to move toward and away from the first panel 150. The side portions 154 may extend only partially along a length of the sides of the first panel 150 and/or second panel 152 and can be constructed of webbing in some embodiments. The first panel 150 and the second panel 152 can be connected along a portion or an entirety of a bottom edge. An upper end portion of the second panel 152 can be coupled separately to the backpack 102 by snap-fit buckles 156 in a manner similar to the lower buckles 116/118. Straps of the backpack 102 or second panel 152 coupled to the buckles 156 can be used to adjust a position of the second panel 152 relative to the first panel 150. Accordingly, large items, such as helmets, can be received within a storage space between the first panel 150 and the second panel 152. The second panel 152 can also incorporate a pocket, such as a pocket accessible via a zipper.

Figure 30:
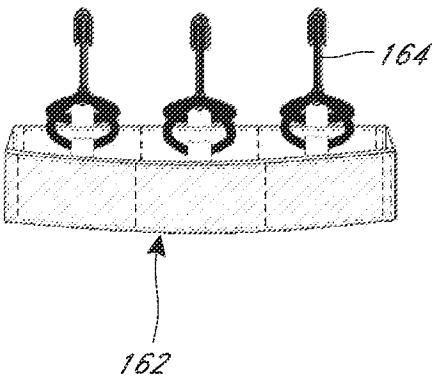
FIG. 30 is a side view of the adapter piece of FIG. 29 separate from the webbing platform.
Figure 29:
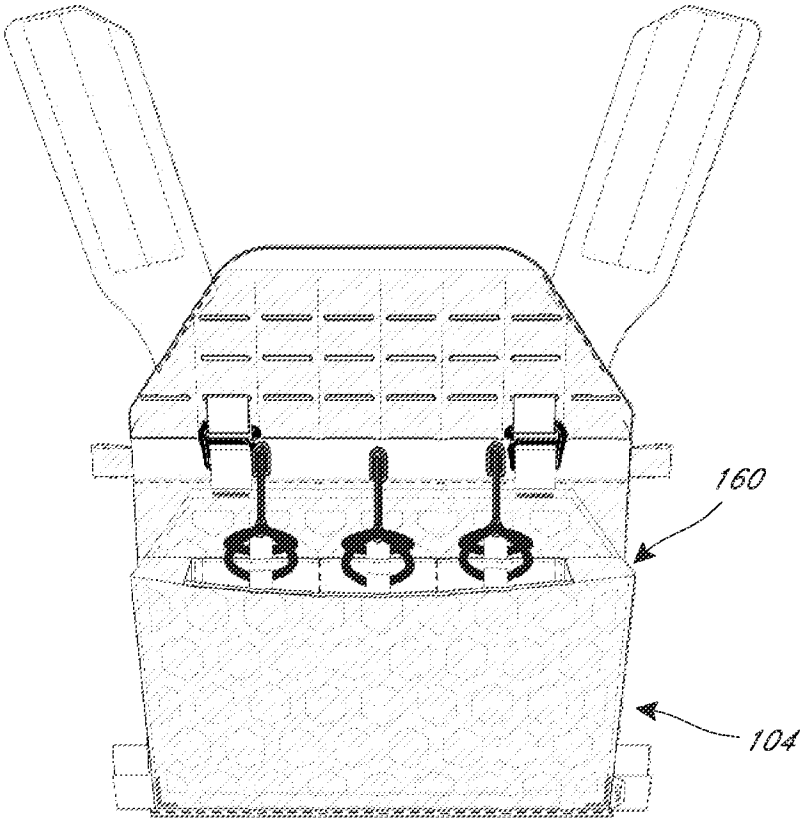
FIG. 29 is a perspective view of an accessory in the form of a webbing platform having a kangaroo pocket and an adapter piece within the pocket.

With reference to FIGS. 29 and 30, another accessory 104 is a webbing platform having a kangaroo pocket 160, which can define a storage space. An adapter piece 162 can be secured within the kangaroo pocket 160, such as by hook-and-loop fastener or otherwise. The adapter piece 162 can define magazine pockets or wells to receive ammunition magazines. A stretch cord 164 or other suitable retention mechanism can be used to secure the ammunition magazines in place within the adapter piece 162 and the kangaroo pocket 160.

Quick Access Pocket Flap

With reference to FIGS. 1-4, in some configurations, the backpack 102 (or other bag or load bearing platform) can include a pocket flap 200 that is quickly and reliably movable from an external orientation, in which the flap 200 is exterior of a space defined by the pocket, to an internal orientation, in which the flap 200 is interior of the space defined by the pocket. In the internal orientation, the flap 200 permits access to the contents of the pocket. Such an arrangement can permit quicker and/or more reliable access to the space or contents of the pocket in comparison to an arrangement in which the flap 200 must be folded back or open to permit access to the pocket. Such arrangements require movement in two directions: 1) a first direction to open the flap, and 2) a second (opposite) direction to access the space of the pocket. The movement in the second direction can result in inadvertent closure of the flap, thus inhibiting or preventing access to the space or contents of the pocket. In contrast, with the illustrated flap 200, the space or contents of the pocket can be accessed with movement in a single direction. The entry of the pocket is configured (e.g., sized and positioned) such that the flap 200 can move from the external orientation to the internal orientation without undue resistance. The flap 200 can have sufficient stiffness to maintain its shape while a user pushes on the flap 200 to move it from the external orientation to the internal orientation.

In some configurations, the front or exterior wall 202 of the pocket can include a rigidizing member or arrangement that helps conceal the contents of the pocket from at least external visual inspection. In other words, the rigidizing member deforms to a lesser extent around the contents of the pocket than would a panel made of a soft material to obfuscate the shape of the contents when viewed from the outside of the front wall 202. In some configurations, the front wall 202 includes a polyethylene (or similar plastic material) board or sheet as the rigidizing element. A foam layer may also be provided. The board and/or foam layers may be provided between the outer layer of the front wall 202 and the interior space of the pocket. The interior space of the pocket can include webbing to permit items (e.g., a holster) to be secured in place within the interior space of the pocket.

Active Compression

An embodiment of a backpack 102 (or other bag or load bearing platform) includes an arrangement configured to automatically move the backpack 102 toward a collapsed orientation. In some such configurations, the backpack 102 has a first portion or first wall 210, a second portion or second wall 212, and a biasing arrangement 214 that produces a force tending to move the first wall 210 towards the second wall 212. The first and second walls 210/212 can be front and rear walls of the backpack 102, respectively, for example. In some configurations, the biasing arrangement is one or more elastic straps 214. The elastic straps 214 can be positioned around a periphery of the first and second walls 210/212 (e.g., at or near the corners). The elastic straps 214 can be connected directly to the first and second walls 210/212 or to intermediate structure (e.g., a side wall of the backpack 102) so long as the intermediate structure can transfer the biasing force to the first and second walls 210/212 or otherwise permit the first and second walls 210/212 to move toward one another. The elastic straps 214 can be positioned internally within a wall of the backpack 102. That is, the elastic straps 214 can be positioned inside of an exterior wall of the backpack 102 and, preferably, between the exterior wall and an interior wall of the backpack 102. Such an arrangement can protect the elastic straps 214 and inhibit or prevent contents of the backpack 102 from interfering with the operation of the elastic straps (or other biasing arrangement) 214.

Alternative Backpack Attachment

With reference to FIGS. 31-36, an embodiment involves a system or method for attaching a backpack to a load bearing platform 102, such as a tactical vest or plate carrier, without using the standard straps of the backpack. The backpack can include a combination of straps 170 (FIGS. 31-33) and a flap 172 (FIGS. 34-36) to secure the backpack to the platform 102. In one configuration, a pair of straps 170 can be provided in a spaced configuration at one end (e.g., an upper end) of the backpack and the flap 172 can be located at the opposite end (e.g., a lower end). Each of the straps 170 can include an anchor 174 configured to engage a portion of the platform 102 adjacent one of a plurality of slots 176, which can be spaced at regular intervals to create a ladder webbing. The flap 172 can include one part of a hook-and-loop fastener.

Figure 32:
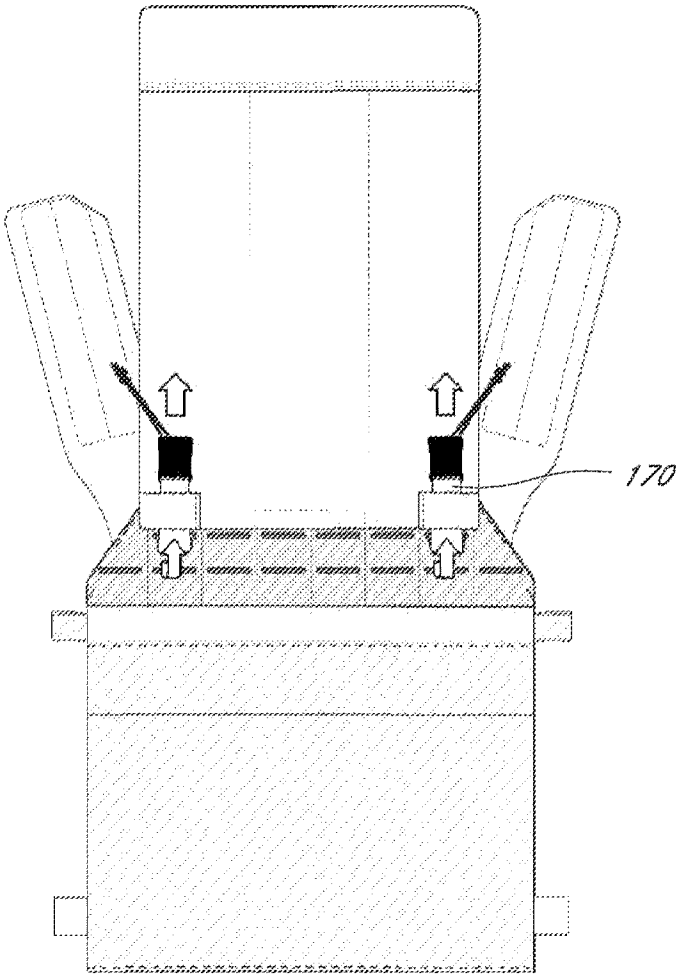
FIG. 32 is another view of the arrangement of FIG. 31 and another step in the connection process.
Figure 31:
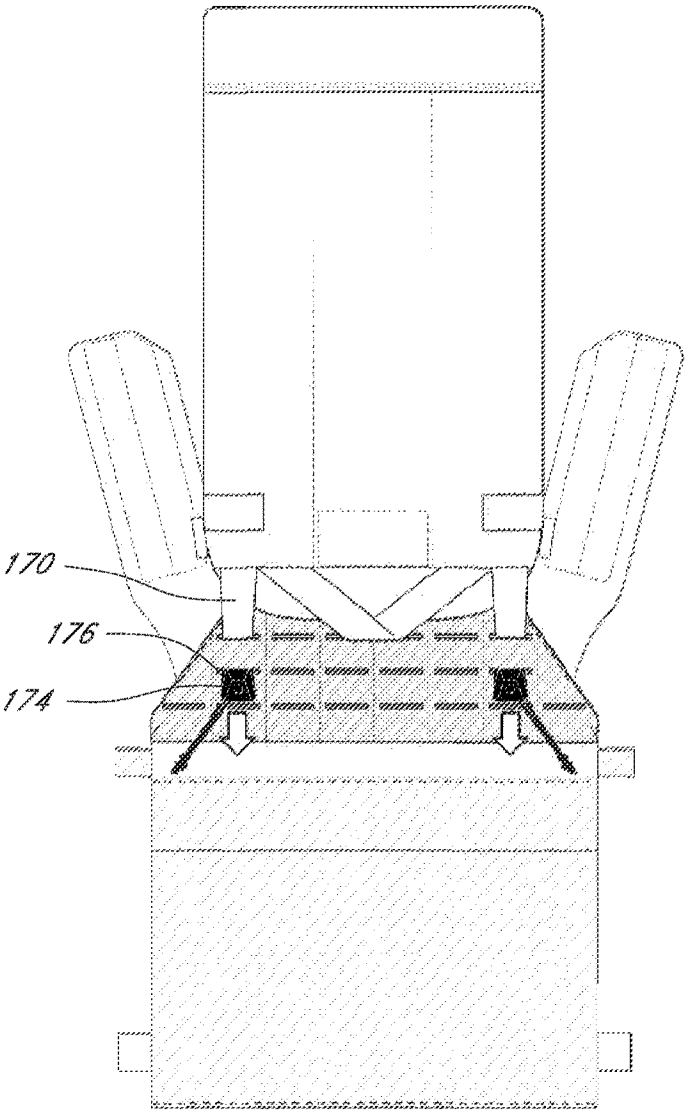
FIG. 31 is a view of an arrangement and a step in a process for connecting a backpack to a tactical vest or plate carrier comprising a strap with an anchor.
Figure 34:
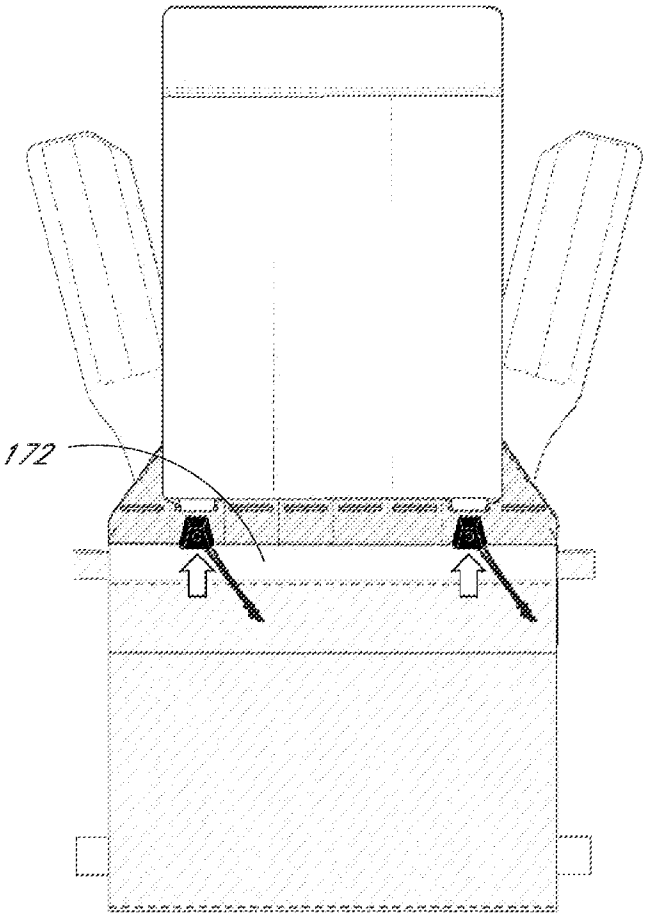
FIG. 34 is another view of the arrangement of FIG. 31 and another step in the connection process.
Figure 33:
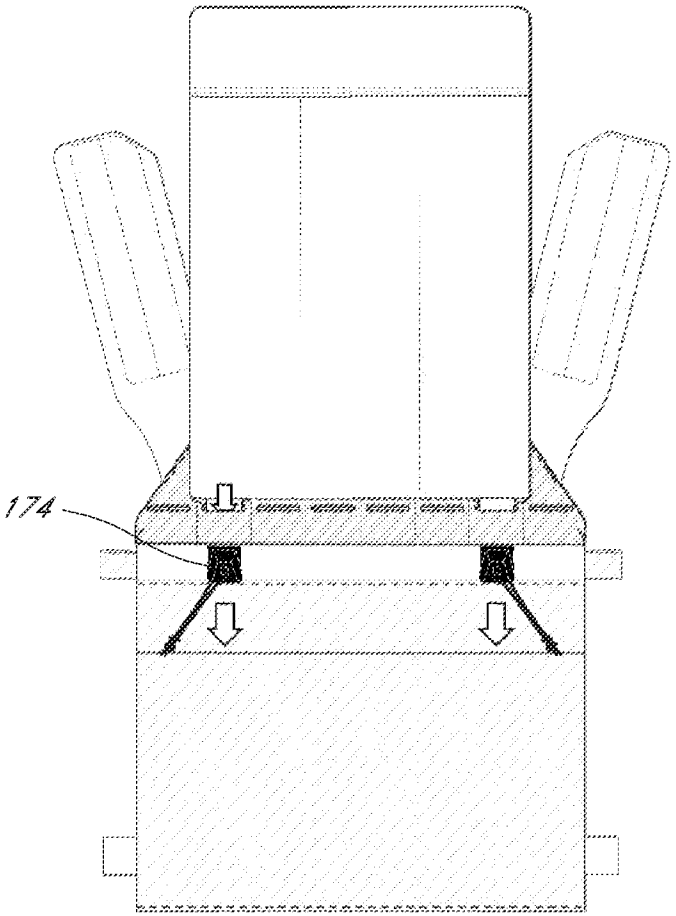
FIG. 33 is yet another view of the arrangement of FIG. 31 and yet another step in the connection process.
Figure 35:
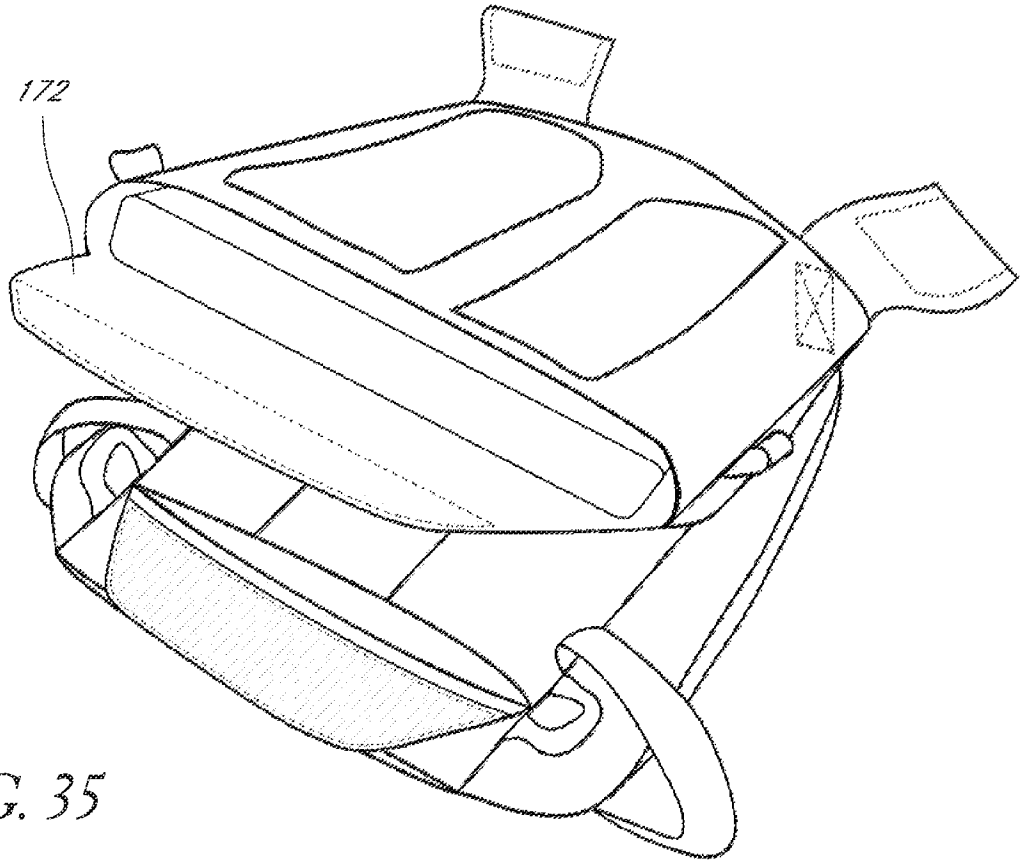
FIG. 35 a partial view of an arrangement for connecting a backpack to a tactical vest or plate carrier comprising a flap, which can be used with the arrangement of FIGS. 31-34.
Figure 36:
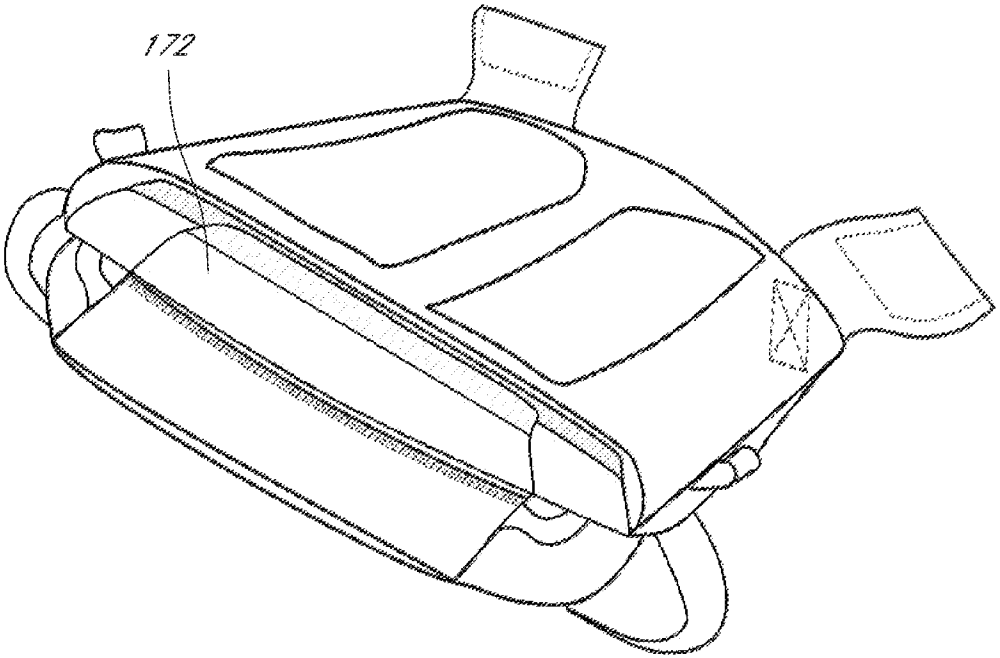
FIG. 36 is yet another partial view of the arrangement of FIG. 34.

The straps 170 can be engaged with the platform 102 (e.g., with ladder webbing) to couple one end of the backpack to the platform 102. The flap 172 can be engaged with the platform 102 (e.g., within a pocket or between two layers) to couple the other end of the backpack to the platform 102. To assemble the backpack to the platform 102, each of the straps 170 is woven through the ladder webbing of the platform 102 and secured with the anchor 174. With reference to FIGS. 31 and 32, each strap 170 can be passed through slots of the platform 102 (FIG. 31) and then through loops of the backpack (FIG. 32). With reference to FIGS. 33 and 34, the straps 170 can be passed back through slots of the platform 102 (FIG. 33) and the anchor 174 secured to the platform 102 adjacent a slot (FIG. 34). With reference to FIGS. 35 and 36, at least one surface of the flap 172 includes a part of a hook-and-loop fastener, such as the hook portion. At least one surface of the platform 102 includes the other part of a hook-and-loop fastener, such as the loop portion. The surface of the platform 102 can be a surface located within a pocket or between two adjacent layers (FIG. 35). Accordingly, the flap 172 can be received and secured within the pocket or between the two adjacent layers (FIG. 36). In some configurations, the layers of the platform 102 can be secured together by opposing parts of a hook-and-loop fastener and the flap 172 can include the cooperating parts of a hook-and-loop fastener on opposing sides so that each side of the flap 172 is secured to the adjacent surface or layer of the platform 102.

Double-to-Single Convertible Bag

Figure 38:
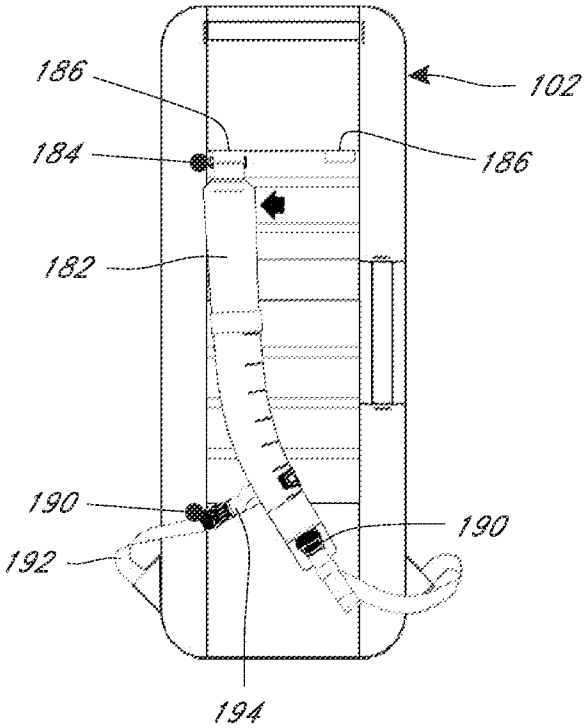
FIG. 38 is a view of the convertible backpack in a single strap configuration.
Figure 37:
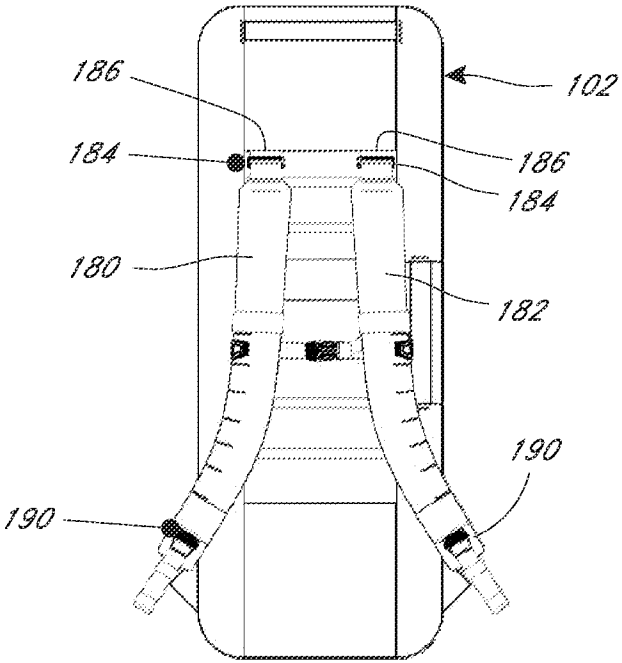
FIG. 37 is a view of a convertible backpack in a double strap configuration.
Figure 39:
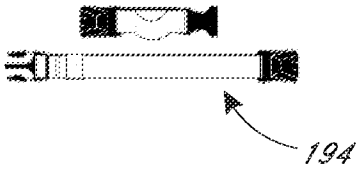
FIG. 39 is a view of a sternum strap of the convertible backpack of FIGS. 37 and 38.

With reference to FIGS. 37-39, an embodiment involves an arrangement for converting a backpack 102 or other type of bag from a double strap configuration to a single strap configuration. In the illustrated arrangement, the backpack 102 includes two straps (e.g., shoulder straps): a first strap 180 and a second strap 182. In some configurations, each of the first strap 180 and the second strap 182 are ergonomic. Each of the first strap 180 and the second strap 182 are non-linear or curved along their lengths. When assembled to the backpack 102 in a double strap configuration, the first strap 180 curves toward its adjacent side of the backpack 102 and the second strap 182 curves toward its adjacent side of the backpack 102. The first strap 180 and the second strap 182 curve away from one another.

An upper end of each of the first strap 180 and the second strap 182 is removably attached to the backpack 102. In some configurations, the upper ends are attached to the backpack 102 by a clip 184, such as a gatekeeper clip that includes a latch that closes and selectively opens an entry to the clip 184 to securely retain the strap 180/182 to the backpack 102. The clip 184 can engage any suitable structure on the backpack 102, such as a loop 186, for example. The lower end of each of the first strap 180 and the second strap 182 is removably attached to the backpack 102, such as by a snap-fit buckle 190 (e.g., a side release (SR) buckle). The backpack 102 can include a strap 192 interposed between a body of the backpack 102 and the SR buckle 190 of each of the first strap 180 and the second strap 182. The backpack 102 can also include a sternum strap 194 (FIG. 39), which preferably includes a portion coupled to each of the first strap 180 and the second strap 182. The portions of the sternum strap 194 preferably are connectable by a SR buckle 190, which is the same as the SR buckles 190 of the first strap 180 and the second strap 182. That is, preferably the cooperating portions of the SR buckles 190 can be attached to one another interchangeably. The sternum strap 194 and the straps 192 of the backpack can also be the same as one another (e.g., 1 inch wide straps); however, it is only necessary that the SR buckles 190 can interchange with one another. In some configurations, the sternum strap 194 is removably attached to one or both of the first strap 180 and the second strap 182. For example, each portion of the sternum strap 194 can include an anchor 196 (the same as or similar to anchor 174) that permits the portion of the sternum strap 194 to be removably attached to the second strap 182.

To convert from a double strap configuration to a single strap configuration, one of the first strap 180 and the second strap 182 is removed from the backpack 102 using the clip 184 and the SR buckle 190. For the sake of example, the figures illustrate the first strap 180 being removed and the second strap 182 remaining on the backpack 102 to serve as the single strap. The upper end of the second strap 182 is moved from its initial position to the opposite side of the backpack 102 using the clip 184 and loop 186 connection. Accordingly, the second strap 182 is now connected to one side of the backpack 102 at the upper end and the opposite side of the backpack 102 at the lower end. The strap 192 of the lower SR buckle 190 that is unused (opposite the side to which the second strap 182 is now connected), can be connected to the cooperating portion of the sternum strap 194. Since only one portion of the sternum strap 194 will include the correct mating part of the SR buckle 190 for the part connected to the unused lower strap 192, it may be necessary to move the correct portion of the sternum strap 194 from the first strap 180 to the second strap 182. The portion of the sternum strap 194 and the unused lower strap 192 can now be used as a cross-body strap in the single strap configuration. Reverting to a double strap configuration involves the reverse of the process described above. A similar process to that described above can be utilized to create a single strap configuration using the first strap 180.

CONCLUSION

It should be emphasized that many variations and modifications may be made to the herein-described embodiments, the elements of which are to be understood as being among other acceptable examples. All such modifications and variations are intended to be included herein within the scope of this disclosure and protected by the following claims. Moreover, any of the steps described herein can be performed simultaneously or in an order different from the steps as ordered herein. Moreover, as should be apparent, the features and attributes of the specific embodiments disclosed herein may be combined in different ways to form additional embodiments, all of which fall within the scope of the present disclosure.

Conditional language used herein, such as, among others, "can," "could," "might," "may," "e.g.," and the like, unless specifically stated otherwise, or otherwise understood within the context as used, is generally intended to convey that certain embodiments include, while other embodiments do not include, certain features, elements and/or states. Thus, such conditional language is not generally intended to imply that features, elements and/or states are in any way required for one or more embodiments or that one or more embodiments necessarily include logic for deciding, with or without author input or prompting, whether these features, elements and/or states are included or are to be performed in any particular embodiment.

Moreover, the following terminology may have been used herein. The singular forms "a," "an," and "the" include plural referents unless the context clearly dictates otherwise. Thus, for example, reference to an item includes reference to one or more items. The term "ones" refers to one, two, or more, and generally applies to the selection of some or all of a quantity. The term "plurality" refers to two or more of an item. The term "about" or "approximately" means that quantities, dimensions, sizes, formulations, parameters, shapes and other characteristics need not be exact, but may be approximated and/or larger or smaller, as desired, reflecting acceptable tolerances, conversion factors, rounding off, measurement error and the like and other factors known to those of skill in the art. The term "substantially" means that the recited characteristic, parameter, or value need not be achieved exactly, but that deviations or variations, including for example, tolerances, measurement error, measurement accuracy limitations and other factors known to those of skill in the art, may occur in amounts that do not preclude the effect the characteristic was intended to provide.

Numerical data may be expressed or presented herein in a range format. It is to be understood that such a range format is used merely for convenience and brevity and thus should be interpreted flexibly to include not only the numerical values explicitly recited as the limits of the range, but also interpreted to include all of the individual numerical values or sub-ranges encompassed within that range as if each numerical value and sub-range is explicitly recited. As an illustration, a numerical range of "about 1 to 5" should be interpreted to include not only the explicitly recited values of about 1 to about 5, but should also be interpreted to also include individual values and sub-ranges within the indicated range. Thus, included in this numerical range are individual values such as 2, 3 and 4 and sub-ranges such as "about 1 to about 3," "about 2 to about 4" and "about 3 to about 5," "1 to 3," "2 to 4," "3 to 5," etc. This same principle applies to ranges reciting only one numerical value (e.g., "greater than about 1") and should apply regardless of the breadth of the range or the characteristics being described. A plurality of items may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary. Furthermore, where the terms "and" and "or" are used in conjunction with a list of items, they are to be interpreted broadly, in that any one or more of the listed items may be used alone or in combination with other listed items. The term "alternatively" refers to selection of one of two or more alternatives, and is not intended to limit the selection to only those listed alternatives or to only one of the listed alternatives at a time, unless the context clearly indicates otherwise.

What is claimed is:

1. A modular gear bag system, comprising:

a gear bag, comprising:

a body with a front, a back, and defining an interior space located in between the front and the back;

a flap connected to the body along one edge and having a free edge such that the flap can be lifted away from the body;

a pair of first connection locations located underneath the flap, each of the pair of first connection locations being spaced apart from one another in a width direction of the gear bag; and a second connection location located below the pair of first connection locations, the second connection location spaced below the flap; and a plurality of accessories, each one of the plurality of accessories comprising:

a pair of first accessory connections each configured to selectively connect with one of the pair of first connection locations of the gear bag; and a second accessory connection configured to selectively connect with the second connection location of the gear bag;

wherein any selected one of the plurality of accessories can be connected to the body of the gear bag by connecting the pair of first accessory connections to the pair of first connection locations and also connecting the second accessory connection to the second connection location.

2. The modular gear bag system of claim 1, wherein the pair of first connection locations and the pair of first accessory connections connect along a first connection direction and second connection location and the second accessory connection connect along a second connection direction that is different than the first connection direction.

3. The modular gear bag system of claim 1, wherein the pair of first accessory connections each comprises a snap-fit buckle.

4. The modular gear bag system of claim 1, wherein the second connection location comprises a webbing.

5. The modular gear bag system of claim 1, wherein the second connection location is positioned across a width direction of the gear bag.

6. The modular gear bag system of claim 1, wherein the second connection location comprises a portion of a hook and loop fastener.

7. The modular gear bag system of claim 1, wherein the pair of first connection locations are positioned on the body of the gear bag.

8. The modular gear bag system of claim 1, further comprising a third connection location on the body of the gear bag configured to selectively connect to a third accessory connection on each one of the plurality of accessories.

9. The modular gear bag system of claim 8, wherein the pair of first connection locations and the pair of first accessory connections connect along a first connection direction and the second connection location and the second accessory connection connect along a second connection direction that is different than the first connection direction; and wherein the third connection location and the third accessory connection connect along the second connection direction.

* * * * *